US009700185B1

(12) United States Patent
Roberts

(10) Patent No.: US 9,700,185 B1
(45) Date of Patent: Jul. 11, 2017

(54) RUG CLEANING APPARATUS TO RINSE, DECONTAMINATE AND EVACUATE FLUIDS AND UNDESIRABLE PARTICULATES

(71) Applicant: Joe Ray Roberts, Etna, WY (US)

(72) Inventor: Joe Ray Roberts, Etna, WY (US)

( * ) Notice: Subject to any disclaimer, the term of this patent is extended or adjusted under 35 U.S.C. 154(b) by 0 days.

(21) Appl. No.: 15/180,443

(22) Filed: Jun. 13, 2016

Related U.S. Application Data

(60) Provisional application No. 62/174,021, filed on Jun. 11, 2015.

(51) Int. Cl.

| | |
|---|---|
| ***A47L 5/00*** | (2006.01) |
| ***A47L 7/00*** | (2006.01) |
| *A47L 5/06* | (2006.01) |
| *A47L 9/02* | (2006.01) |
| *A47L 5/38* | (2006.01) |
| *A47L 9/04* | (2006.01) |
| *A47L 5/22* | (2006.01) |

(52) U.S. Cl.
CPC ..... *A47L 7/0019* (2013.01); *A47L 5/06* (2013.01); *A47L 5/22* (2013.01); *A47L 5/38* (2013.01); *A47L 7/0004* (2013.01); *A47L 9/02* (2013.01); *A47L 9/0477* (2013.01)

(58) Field of Classification Search
CPC ..... A47L 5/06; A47L 5/22; A47L 5/38; A47L 7/004; A47L 7/0019; A47L 9/02; A47L 9/0477
IPC ..... A47L 5/00
See application file for complete search history.

(56) References Cited

U.S. PATENT DOCUMENTS

| | | | | |
|---|---|---|---|---|
| 1,601,774 A * | 10/1926 | Scheffer | A47L 9/02 | 15/415.1 |
| 6,152,151 A * | 11/2000 | Bolden | A47L 7/0009 | 134/21 |
| 2006/0042040 A1* | 3/2006 | Dever | A47L 9/0477 | 15/383 |
| 2010/0101044 A1* | 4/2010 | Salmond | A47L 9/08 | 15/363 |

* cited by examiner

*Primary Examiner* — David Redding
(74) *Attorney, Agent, or Firm* — Plager Schack LLP

(57) ABSTRACT

A rug cleaning apparatus to rinse, decontaminate and evacuate fluid or undesirable particulates from the rug with enhanced efficiency is provided. The cleaning apparatus includes a tubular member having a first end, a second end and a side wall, the tubular member having a plurality of openings disposed thereto evenly throughout the side wall, a cap coupled to the second end of the tubular member, and a vacuum coupled to the first end of the tubular member. The tubular member permits the rug to be disposed around the side wall. The vacuum activates to generate sufficient airflow and pressure within the tubular member to draw fluid or undesirable particulates in the rug through the openings of the tubular member and out to the vacuum for a disposal.

6 Claims, 4 Drawing Sheets

RUG CLEANING APPARATUS TO RINSE, DECONTAMINATE AND EVACUATE FLUIDS AND UNDESIRABLE PARTICULATES

RELATED APPLICATION

The application claims priority to provisional patent application U.S. Ser. No. 62/174,021 filed on Jun. 11, 2015, the entire contents of which is herein incorporated by reference.

BACKGROUND

The embodiments herein relate generally to devices for cleaning rugs.

Area rug cleaning and washing has many risks to the professional cleaner. The equipment used to extract and/or evacuate water and cleaning solution from the rug is expensive to purchase and maintain, and requires significant amounts of energy to operate. Typically, this equipment comprises machines that take up significant space, create hazardous working environments and cause damage to delicate textiles. As a result, these machines are impractical for the majority of mid-size cleaning companies.

Smaller companies are utilizing underpowered portable extraction machines and general devices made for wall-to-wall carpet cleaning. However, these devices are inefficient and do not remove the majority of water and cleaning solution in the rug. This is undesirable because the devices often leave the area rug with a crusty pile, browning fringes and inadvertent color changes caused by dyes in the rug that migrate during the elongated drying process. This places significant burdens on the cleaning companies due to unhappy clients and the additional costs required to remedy the rugs and cover liabilities. Other machinery designed to clean synthetic wall-to-wall carpets exists in the industry. However, this machinery is not safe for use with area rugs. In particular, the amount of heat and pressure generated by this machinery damages the delicate fibers and dyes of the rug.

As such, there is a need in the industry for a rug cleaning apparatus for use with area rugs or other textiles that overcomes the limitations of the prior art. More specifically, there is a need for a rug cleaning apparatus that rinses, decontaminates and evacuates fluid and/or undesirable particulates from the rug evenly and with enhanced efficiency.

SUMMARY

A cleaning apparatus for use with a rug to rinse, decontaminate and evacuate fluid or undesirable particulates from the rug with enhanced efficiency is provided. The cleaning apparatus comprises a tubular member comprising a first end, a second end and a side wall connecting the first and second ends, the tubular member comprising a plurality of openings disposed thereto evenly throughout the side wall, a cap coupled to the second end of the tubular member, and a vacuum coupled to the first end of the tubular member, wherein the tubular member is configured to permit the rug to be disposed around the side wall, wherein the vacuum is configured to activate to generate sufficient airflow and pressure within the tubular member to draw fluid or undesirable particulates in the rug through the openings of the tubular member and out to the vacuum for a disposal, thereby evacuating the fluid or particulates from the rug.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
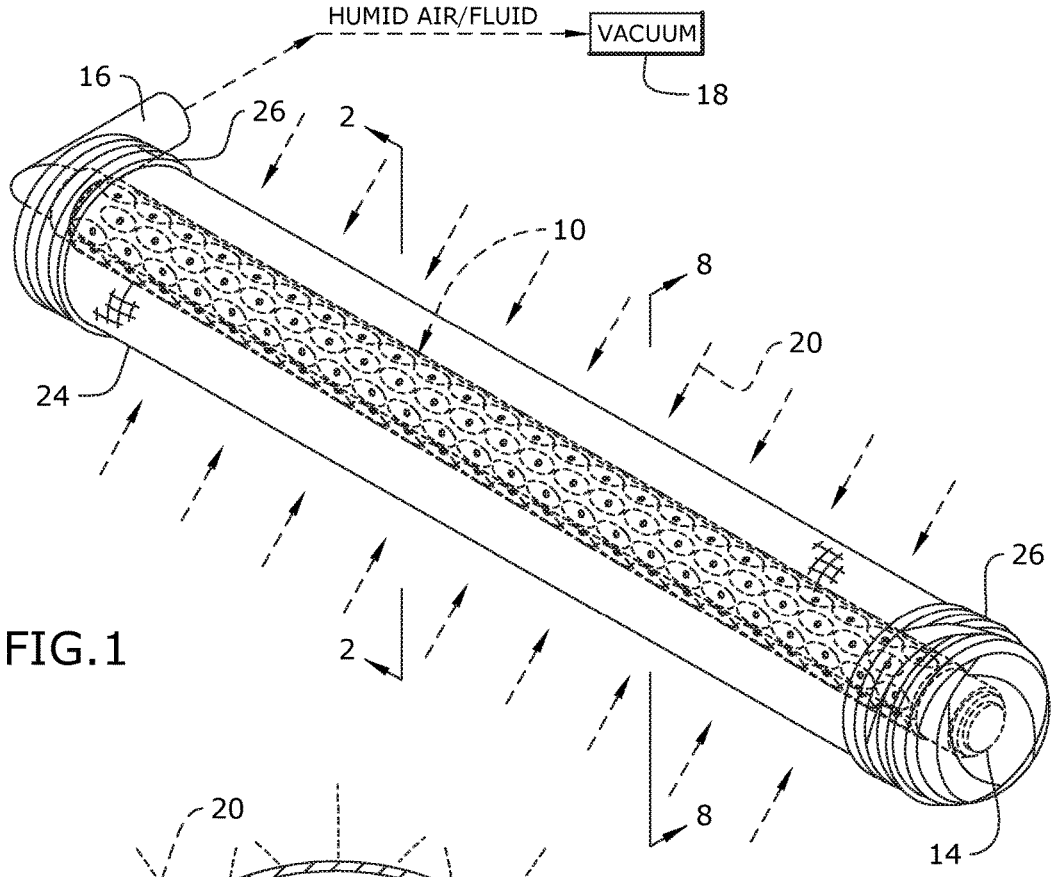
FIG. 1 depicts a perspective view of certain embodiments of the rug cleaning apparatus shown in use.
Figure 2:
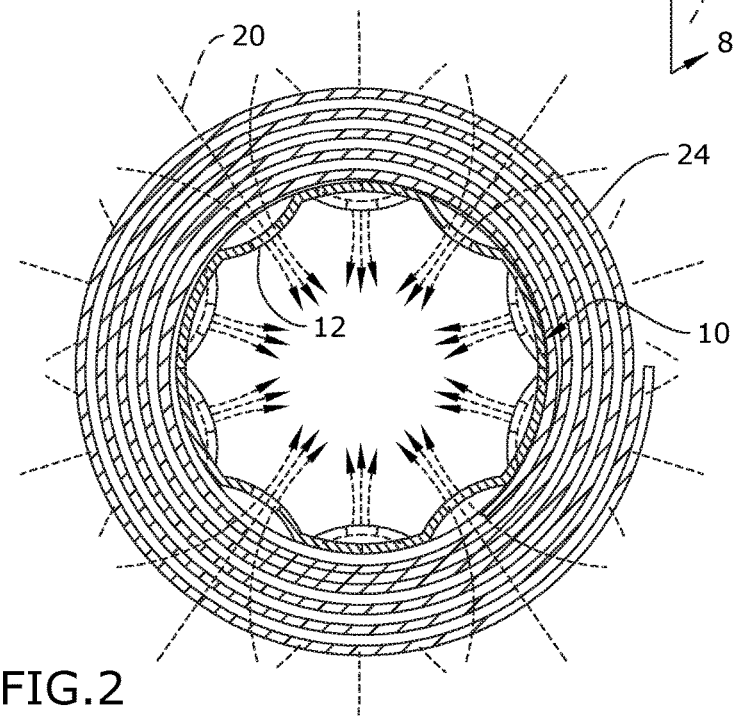
FIG. 2 depicts a section view of certain embodiments of the rug cleaning apparatus taken along line 2-2 in FIG. 1.
Figures 3, 4, 5:
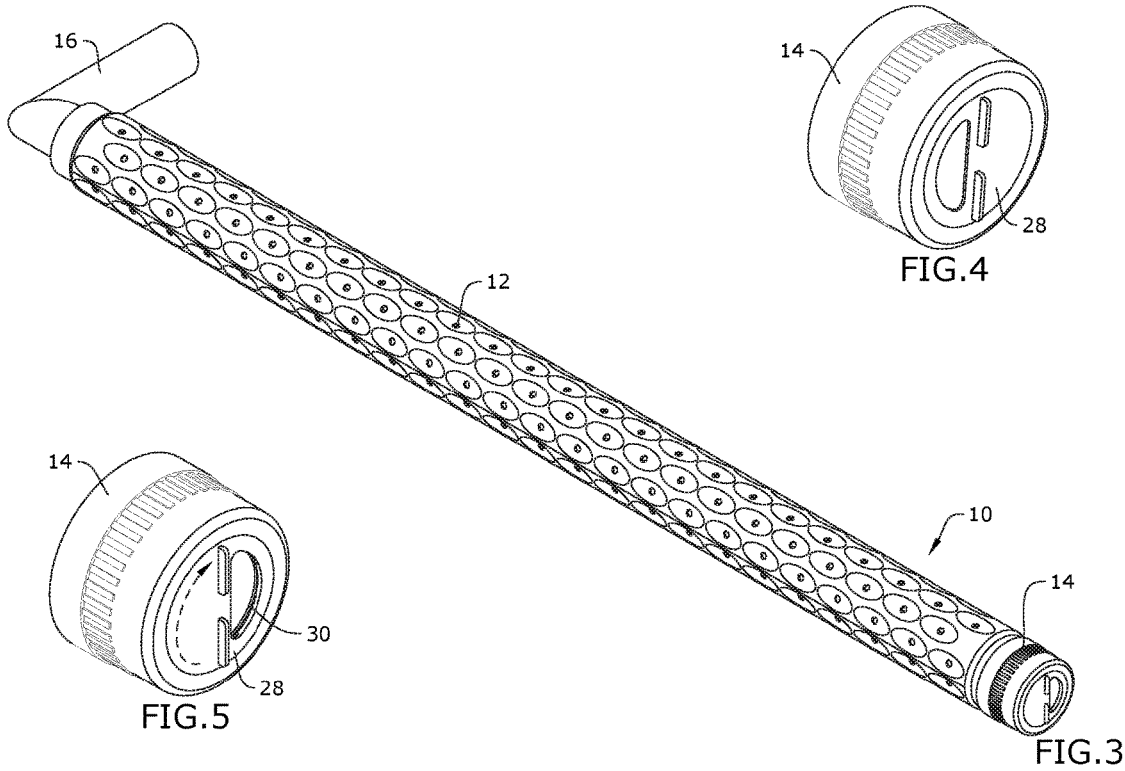
FIG. 3 depicts a perspective view of certain embodiments of the rug cleaning apparatus.
FIG. 4 depicts a perspective view of certain embodiments of the rug cleaning apparatus.
FIG. 5 depicts a perspective view of certain embodiments of the rug cleaning apparatus.

As depicted in FIGS. 1-3, the cleaning apparatus is configured to wash, rinse, decontaminate, and evacuate fluid and/or undesirable particulates from rug 24 with enhanced efficiency. Rug 24 is preferably a movable area rug that is not permanently affixed to the ground. It shall be appreciated that rug 24 may have variable shapes and sizes. The cleaning apparatus generally comprises tubular member 10, cap 14, attachment tube 16 and vacuum 18.

Tubular member 10 is preferably made from injection molded plastic and comprises a plurality of tube holes 12 disposed evenly throughout the side wall of the member. In a preferred embodiment, a plurality of dimples are disposed throughout tubular member 10 such that each dimple surrounds one of the plurality of tube holes 12. Tubular member 10 is approximately 3' in length and comprises a diameter within the range of 3"-3.65". Each tube hole 12 comprises a diameter of approximately 3-4 millimeters and is positioned approximately 1"-1.375" from each adjacent tube hole 12.

As depicted in FIGS. 3-5, cap 14 comprises opening 30 and is detachably coupled to an end of tubular member 10. Cover 28 is rotatably mounted to cap 14 and is configured to adjust the size of opening 30 that is exposed. By adjusting the size of opening 30 exposed, airflow and pressure within tubular member 10 can be adjusted to a desired level.

Attachment tube 16 is coupled to the other end of tubular member 10 and is coupled to vacuum 18. In a preferred embodiment, attachment tube 16 is a transparent generally L-shaped tube that permits a user (not shown) to view fluid and/or undesirable particulates such as dirt or cleaning agents as they pass through the tube after evacuation from rug 24. Attachment tube 16 comprises a swivel member (not shown) coupled to tubular member 10. This permits tubular member 10 to rotate while attachment tube 16 is in a stationary position, such as when disposed on the ground.

Vacuum 18 is preferably rated at greater than or equal to 250 cubic feet per minute (CFM) of airflow and a minimum of 10" Hg. Vacuum 18 is configured to generate sufficient air flow and pressure within tubular member 10 to permit air inflow 20 to pass through rug 24 and into tubular member 10 via tube holes 12 and air outflow 22 to travel out of tubular member 10 to vacuum 18 through attachment tube 16. During this process, fluid and/or particulates in rug 24 travel through tube holes 12, tubular member 10 and attachment tube 16, and are evacuated to vacuum 18 for a disposal.

Figure 6:
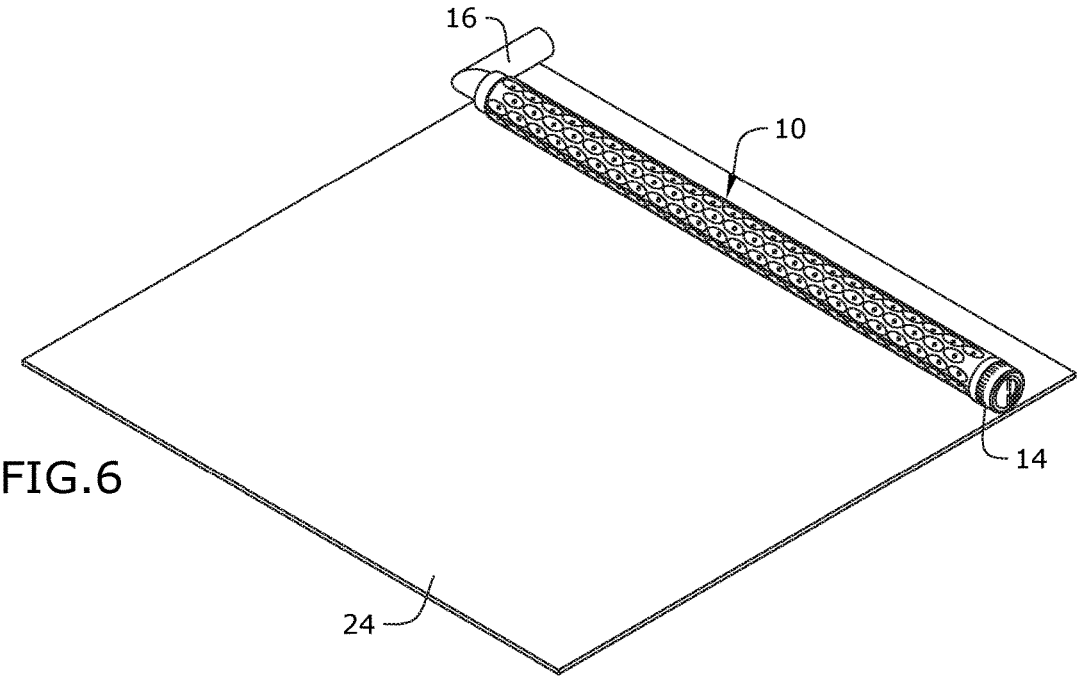
FIG. 6 depicts a perspective view of certain embodiments of the rug cleaning apparatus.
Figure 7:
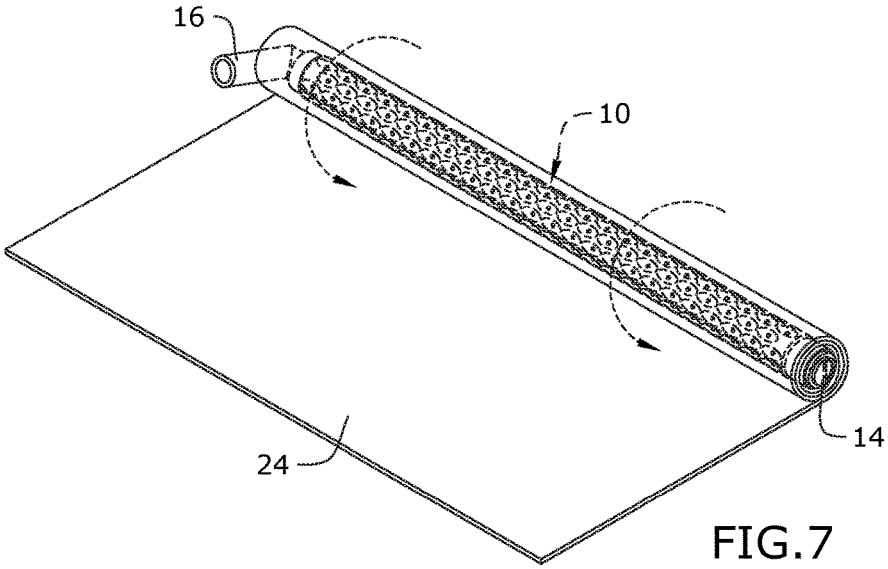
FIG. 7 depicts a perspective view of certain embodiments of the rug cleaning apparatus.
Figure 8:
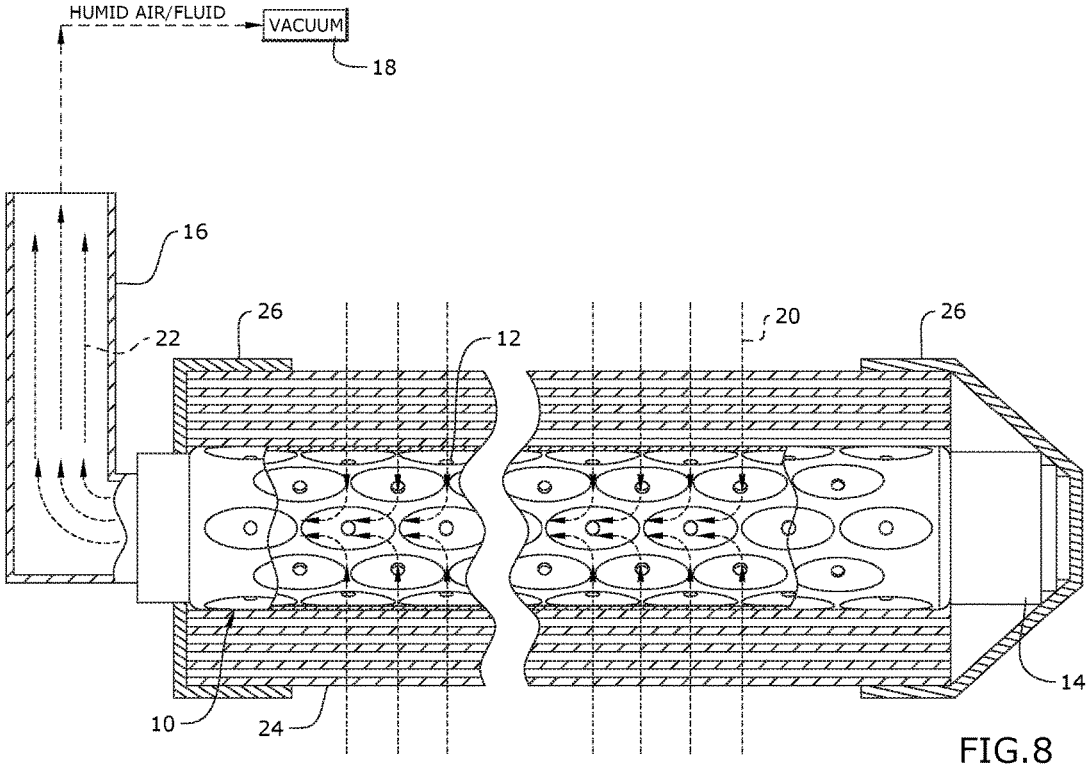
FIG. 8 depicts a section view of certain embodiments of the rug cleaning apparatus taken along line 8-8 in FIG. 1.

In operation, the cleaning apparatus is positioned on top of rug 24, which is disposed on the ground as depicted in FIG. 6. Rug 24 may be saturated with water, cleaning solution, dirt or other particles. In alternative embodiments, multiple tubular members 10 may be connected together (not shown) to accommodate different sized rugs. As depicted in FIG. 7, rug 24 is tightly wound around tubular member 10 until the rug forms several layers around the tubular member. Attachment tube 16 is coupled to vacuum 18 and tubular member 10. Cap 14 is secured to tubular member 10. In this configuration, the cleaning apparatus is ready for use. As depicted in FIGS. 1-2 and 8, cover members 26 are preferably disposed on the ends of tubular member 10. Specifically, a first cover member 26 is disposed around rug 24 proximate attachment tube 16 and a second cover member 26 is disposed around rug 24 and cap 14. Cover members 26 are configured to minimize air flow and pressure loss within tubular member 10 when vacuum 18 is enabled. In a preferred embodiment, cover members 26 are made from a non-breathable and water-proof fabric material.

As depicted in FIGS. 1-2 and 8, vacuum 18 is enabled to generate sufficient airflow and pressure within attachment tube 16 and tubular member 10 to permit air inflow 20 through tube holes 12 and air outflow 22 out of tubular member 10. This action causes any moisture, fluid and/or particulates such as cleaning agents or dirt in the layers of rug 24 to be drawn in through tube holes 12 and evacuated out to vacuum 18 through tubular member 10 and attachment tube 16. During this process, the innermost layer of rug 24 conforms to the uneven surface of tubular member 10 created by the dimples, which further minimizes vacuum loss within tubular member 10. Cover 28 on cap 14 can be rotatably adjusted to generate the desired airflow and pressure within tubular member 10 to evacuate moisture, fluid and/or particulates from rug 24.

The cleaning apparatus can perform a variety of tasks. For example, rug 24 can be decontaminated by placing a cleaning solution or detergent on the outer layer of rug 24 when disposed around tubular member 10. When vacuum 18 is enabled, the cleaning solution and/or detergent is pulled through each layer of rolled rug 24 and evacuated to vacuum 18 through tubular member 10 and attachment tube 16. For washing and rinsing functions, any combination of fresh water, rinsing agents or soap can be placed on the outer layer of rug 24. When vacuum 18 is enabled, these elements are pulled through each layer of rolled rug 24 and evacuated to vacuum 18 in the same manner. For drying functions, rug 24 can remain disposed around tubular member 10. When vacuum 18 is enabled, ambient air is drawn in through all the layers of rolled rug 24, thereby expediting the drying process. In an alternative embodiment, an external hot air source may also be positioned proximate rug 24 to further enhance drying efficiency.

In an alternative embodiment, rug 24 can be 'puckered' tighter around tubular member 10 of the cleaning apparatus during the final extraction and drying process. This enables the wringing of the fibers of rug 24 to be more fully recognized. The wringing effect is achieved by covering rug 24 in its entirety with a non-breathable cloth or sheet (not shown). This causes the complete halt of air to move through rug 24 and into the cleaning apparatus. During this process, the vacuum lift created by the apparatus wrings the rug fibers of moisture as rug 24 is 'puckered or squeezed' tighter around tubular member 10. Once the limits of puckering are reached, a user (not shown) can remove the non-breathable cloth or sheet in sections to allow air movement to flow through rug 24 to focus on any one specific area. Alternatively, the non-breathable cloth or sheet can be completely removed from rug 24 to allow air to flow through equally throughout the rug.

All of these functions can be performed by the cleaning apparatus without damaging the delicate fibers and colors of rug 24. Since tube holes 12 are distributed throughout tubular member 10, air inflow 20 is evenly distributed throughout the entire surface of rug 24 at the same rate. This enhances the apparatus' efficiency in washing, rinsing, decontaminating, and evacuating fluid and/or undesirable particulates from rug 24.

In an alternative embodiment, a hook member (not shown) may be used to couple the cleaning apparatus to a structural member to support tubular member 10 in a generally vertical position. In this configuration, gravity may aid in the evacuation of moisture, fluid and/or particulates from tubular member 10. In an alternative embodiment, attachment tube 16 may be connected to a pump (not shown) with tubular member 10 and rug 24 disposed thereon submerged beneath a pool of cleaning solution. When the pump is activated, the cleaning solution from the pool is drawn in through the layers of rug 24 and evacuated through tubular member 10 and attachment tube 16. This provides the user with an alternative process for cleaning rug 24.

It shall be appreciated that the components of the cleaning apparatus described in several embodiments herein may comprise any alternative known materials in the field and be of any color, size and/or dimensions. It shall be appreciated that the components of the cleaning apparatus described herein may be manufactured and assembled using any known techniques in the field. Although embodiments of the invention have described the cleaning apparatus for use with a rug, it shall be appreciated that the apparatus may be used with other textiles known in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cleaning apparatus for use with a rug to rinse, decontaminate and evacuate fluid or undesirable particulates from the rug with enhanced efficiency, the cleaning apparatus comprising:

a tubular member comprising a first end, a second end and a side wall connecting the first and second ends, the tubular member comprising a plurality of openings disposed thereto evenly throughout the side wall;

a cap coupled to the second end of the tubular member;

a vacuum coupled to the first end of the tubular member; and wherein the tubular member comprises a plurality of dimples, each dimple of the plurality of dimples surrounding one of the plurality of openings in the side wall of the tubular member, and the tubular member is configured to permit the rug to be disposed around the side wall, wherein the vacuum is configured to activate to generate sufficient airflow and pressure within the tubular member to draw fluid or undesirable particulates in the rug through the openings of the tubular member and out to the vacuum for a disposal, thereby evacuating the fluid or particulates from the rug.

2. The cleaning apparatus of claim 1, wherein the cap comprises an opening and a cover rotatably mounted to the cap, wherein the cover is rotatably adjusted to open or close the opening in the cap, thereby adjusting the air flow and pressure within the tubular member when the vacuum is activated.

3. The cleaning apparatus of claim 2, further comprising an attachment tube comprising a first end coupled to the first end of the tubular member by a swivel member and a second end coupled to the vacuum.

4. The cleaning apparatus of claim 3, wherein the attachment tube is transparent.

5. The cleaning apparatus of claim 3, further comprising a first cover member disposed around the rug and the first end of the tubular member and a second cover member disposed around the rug and the cap, each cover member of the first and second cover members configured to minimize a loss of the air flow and pressure within the tubular member.

6. The cleaning apparatus of claim 5, wherein each cover member of the first and second cover members is made from a non-breathable and water-proof fabric material.

* * * * *